US007469504B2

(12) United States Patent
Nocella

(10) Patent No.: US 7,469,504 B2
(45) Date of Patent: Dec. 30, 2008

(54) APPARATUS FOR FILTERING AND SELECTIVELY CRUSHING AND GRINDING DEBRIS AS WELL AS RESTRAINING LARGE DEBRIS FROM PASSING THERETHROUGH

(76) Inventor: Raymond L. Nocella, 162 Stagecoach Rd., Sicklerville, NJ (US) 08081

( * ) Notice: Subject to any disclaimer, the term of this patent is extended or adjusted under 35 U.S.C. 154(b) by 304 days.

(21) Appl. No.: 11/270,119

(22) Filed: Nov. 9, 2005

(65) Prior Publication Data

US 2007/0107319 A1 May 17, 2007

(51) Int. Cl.

| | |
|---|---|
| ***E04D 13/00*** | (2006.01) |
| ***E04D 13/08*** | (2006.01) |
| ***B01D 27/00*** | (2006.01) |
| ***B01D 29/00*** | (2006.01) |
| ***B01D 29/07*** | (2006.01) |
| ***B02C 1/00*** | (2006.01) |

(52) U.S. Cl. ..... 52/12; 52/16; 210/350; 210/352; 210/497.3

(58) Field of Classification Search ..... 52/11–16; 210/350–352, 494.1, 494.2, 497.3; 241/283
See application file for complete search history.

(56) References Cited

U.S. PATENT DOCUMENTS

| | | | | | |
|---|---|---|---|---|---|
| 1,787,112 | A | * | 12/1930 | King | 15/104.32 |
| 3,118,159 | A | * | 1/1964 | Kollmann | 15/104.33 |
| 3,292,198 | A | | 12/1966 | Perkel | |
| 3,740,787 | A | | 6/1973 | Bowermaster | |
| 3,828,931 | A | | 8/1974 | Henricksen | |
| 4,116,008 | A | | 9/1978 | Ward | |
| 4,241,547 | A | | 12/1980 | Bovė | |
| 4,364,140 | A | * | 12/1982 | Irwin | 15/104.33 |
| 4,433,449 | A | | 2/1984 | Rainey | |
| 4,709,516 | A | * | 12/1987 | Gleaves | 52/11 |
| 4,807,406 | A | * | 2/1989 | Densmore | 52/11 |
| 4,837,987 | A | | 6/1989 | Fender | |
| 4,852,308 | A | | 8/1989 | Papenbrock et al. | |
| 5,335,460 | A | | 8/1994 | Smith, Jr. | |
| 5,548,931 | A | | 8/1996 | Bryant | |
| 5,586,837 | A | | 12/1996 | Udelle | |
| 5,727,350 | A | | 3/1998 | Marcella | |
| 5,802,775 | A | | 9/1998 | Toth | |
| 5,855,402 | A | | 1/1999 | Maraschiello | |
| 5,867,945 | A | | 2/1999 | Scafidi | |
| 5,988,715 | A | | 11/1999 | Mason | |
| 5,989,357 | A | | 11/1999 | Vilhauer, Jr. et al. | |
| 6,017,070 | A | | 1/2000 | Poppa | |
| 6,076,307 | A | | 6/2000 | Kean | |
| 6,139,077 | A | | 10/2000 | Molzan, II | |

(Continued)

OTHER PUBLICATIONS

"How to Repair Downspouts and Gutters." Dulley.com. Oct. 15, 2004. Dec. 12, 2007. <http://web.archive.org/web/20041015051606/http://www.dulley.com/diy/df103.htm>.*

*Primary Examiner*—Richard E Chilcot, Jr.
*Assistant Examiner*—Branon C Painter
(74) *Attorney, Agent, or Firm*—Volpe and Koenig, P.C.

(57) ABSTRACT

A pair of counter-wound spring-like members are placed in a gutter above an opening communicating with a downspout. A cord joined to the spring-like members extends through said downspout and out of an opening in the downspout. The cord is pulled and released to contract and expand the spring-like members to grind and/or crush debris collected in the gutter.

6 Claims, 2 Drawing Sheets

U.S. PATENT DOCUMENTS 6,240,679 B1 6/2001 Smalara
6,254,153 B1 7/2001 Poppa
6,263,618 B1 7/2001 Jones
6,454,329 B1 9/2002 Collins, Jr.
6,471,271 B1 10/2002 Segal
6,526,619 B1 3/2003 Cassels, Jr.
6,598,352 B2 7/2003 Higginbotham
6,611,983 B1 9/2003 Hopey
6,739,800 B2 * 5/2004 Bevilacqua ..... 405/48
6,833,067 B2 12/2004 Dresmann

* cited by examiner

APPARATUS FOR FILTERING AND SELECTIVELY CRUSHING AND GRINDING DEBRIS AS WELL AS RESTRAINING LARGE DEBRIS FROM PASSING THERETHROUGH

FIELD OF THE INVENTION

The present invention relates to the handling of debris in rain gutters and the like and more particularly to apparatus for grinding and crushing debris utilizing manually operable mechanical means and further for restraining oversized debris from passing into a downspout.

BACKGROUND OF THE INVENTION

A typical and often troublesome and time consuming undertaking is the cleaning and clearing of rain gutters. Most notably in the fall season, leaves, twigs, flowers and other like matter often find their way into gutters causing them to be clogged and requiring tedious and costly manual labor to clear the gutters and further necessitating that individuals climb up ladders and/or climb onto roofs to clear the gutters. It is therefore extremely advantageous to provide method and apparatus for clearing gutters in a simple and easy manner and without the need to climb ladders or climb onto roofs to perform these functions.

SUMMARY

The present invention is characterized by comprising method and apparatus for clearing debris from gutters and the like and comprising a pair of counter-wound, elongated, tapered helical-shaped, spring-like members joined at their tip ends and placed adjacent to an end wall of a gutter and above an opening in the gutter communicating with a downspout. An activating cord has a first end coupled in common to the joined ends of the counter-wound spring-like members and extends through the windings of spring-like members and then downwardly through the gutter opening and downspout to a location near the ground which is easily accessible to an operator to crush and clear debris from the gutter. The end of the cord near to the ground extends through an opening in the downspout.

In operation, the cord is pulled in a downward direction causing the counter-wound spring-like members to contract, thereby crushing and/or grinding debris captured between adjacent windings of the counter-wound members. The cord is then released, enabling the counter-wound springs to return to their normal expanded condition. This operation may be repeated a plurality of times to achieve the desired grinding/crushing action. Contraction of the counter-wound spring-like members is assured by engagement of the large diameter ends of the spring-like members against an end wall of the gutter adjacent the open communicating with the downspout. The crushing/grinding operation reduces the debris to a size capable of being passed through the pair of counter-wound members and the downspout.

OBJECTS OF THE INVENTION AND A BRIEF DESCRIPTION OF THE FIGURES

It is therefore one object of the invention to provide novel method and apparatus for removing debris and especially large sized debris from a gutter from a location remote from the gutter to eliminate the need to climb up to a gutter to perform the operation.

Still another object of the present invention is to provide novel method and apparatus for clearing debris from a gutter utilizing a pair of counter-wound spring-like members arranged within the gutter above an opening communicating with a downspout and provided with an operating cord for selectively expanding/contracting the counter-wound spring-like members for grinding/crushing debris collected in the gutter.

The above as well as other objects of the present invention will become apparent when reading the accompanying description and drawings wherein like elements are designated by like numbers and wherein.

DETAILED DESCRIPTION OF THE INVENTION AND PREFERRED EMBODIMENTS THEREOF

Figure 1:
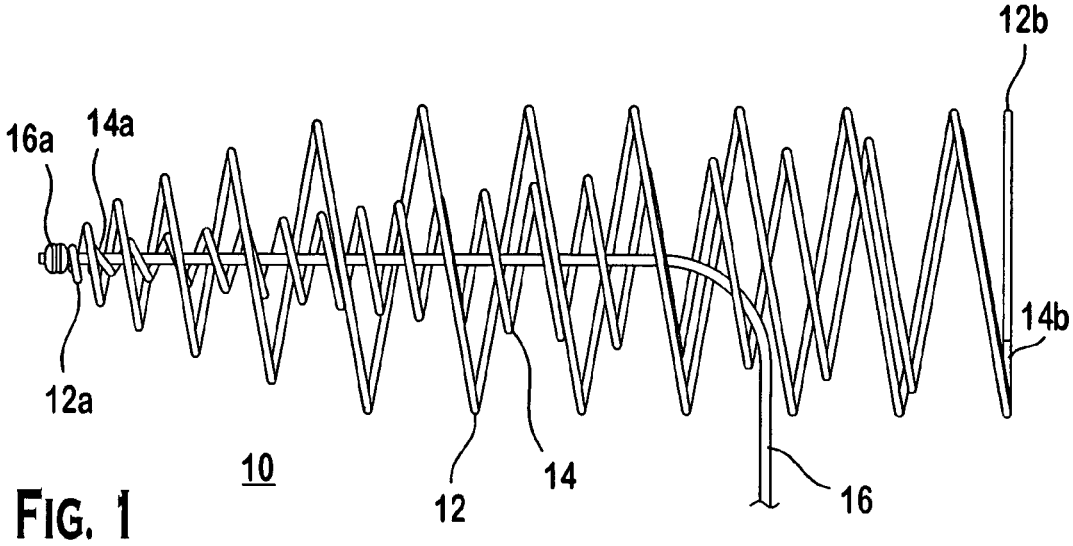
FIG. 1 is a perspective view of a grinding/crushing apparatus designed in accordance with the principles of present invention.

FIG. 1 is a perspective view showing the apparatus 10 embodying the principles of the present invention and comprised of a first helically wound spring-like member 12 having a tapered conical shape tapering from a narrow end or tip 12*a* to a large diameter end 12*b*. As one example, the spring-like members taper from a 1.00 inch to a 4.00 inch diameter over a length of 16.00 inches. A second spring 14 having a similar helical tapered conical shape and wound in the opposite direction has its narrow end or tip 14*a* joined to end 12*a* of spring-like member 12. Spring-like members 12 and 14 are substantially similar in shape and length, the major differences being that one spring is counter-wound relative to the other and one spring is slightly larger in size than the other. The spring-like members 12 and 14 assume a normal, expanded condition shown in FIG. 1 when no contracting force is applied thereto.

Figure 2:
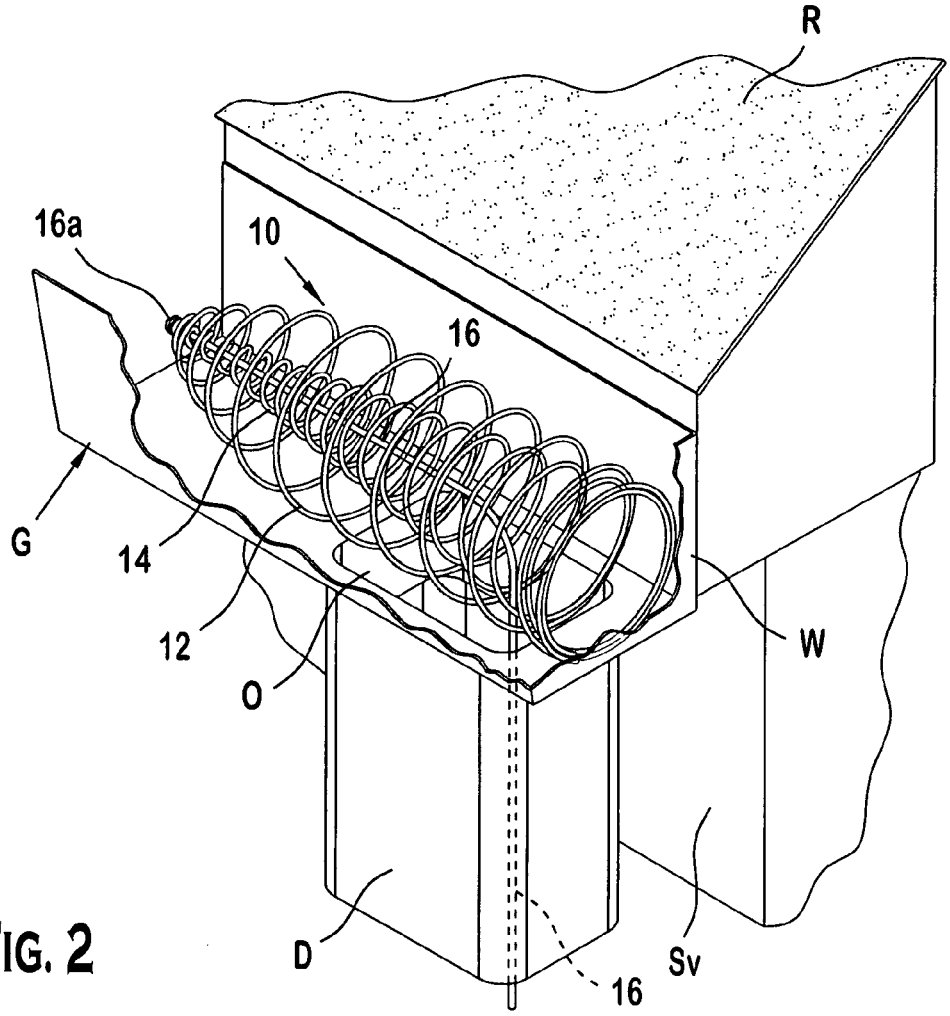
FIG. 2 is a perspective view, partially sectionalized, showing the apparatus of FIG. 1 in its operating position.

An elongated cord 16 has one end thereof 16*a* joined to the tips 12*a*, 14*a* of the spring-like members. Cord 16 extends generally through the central region of members 12 and 14 and extends downwardly near one end thereof. FIG. 2 shows one side of a building structure, such as, for example, house H and a portion of the roof R. A gutter G extends along one vertical side $S_v$ of the house H and extends outwardly from side $S_v$. Water, as well as other debris flows downwardly from the sloping roof R and into the open gutter G. The gutter G is typically sloped to cause water and debris collected in the gutter to move toward the lower, right-hand-end of the gutter, for example, which end is provided with an opening O communicating with downspout D. Obviously, the gutter can be sloped in the opposite direction and have an opening at its left-hand end communicating with a downspout. The debris clearing apparatus 10 is positioned above opening O and further so that the ends 12*b*, 14*b* are in close proximity to end wall W of gutter G. Cord 16 extends through the hollow central region of spring-like members 12 and 14, has one end 16*a* coupled to the ends 14*a*, 12*a* of spring-like members 14 and 12 which are positioned above opening O, and extends downwardly through gutter opening O and through downspout D.

In the normal expanded state, the debris clearing apparatus 10 allows both water and small debris to pass therethrough and to enter and pass through opening O and downspout D to be released near or at ground level, as is conventional.

Figure 3:
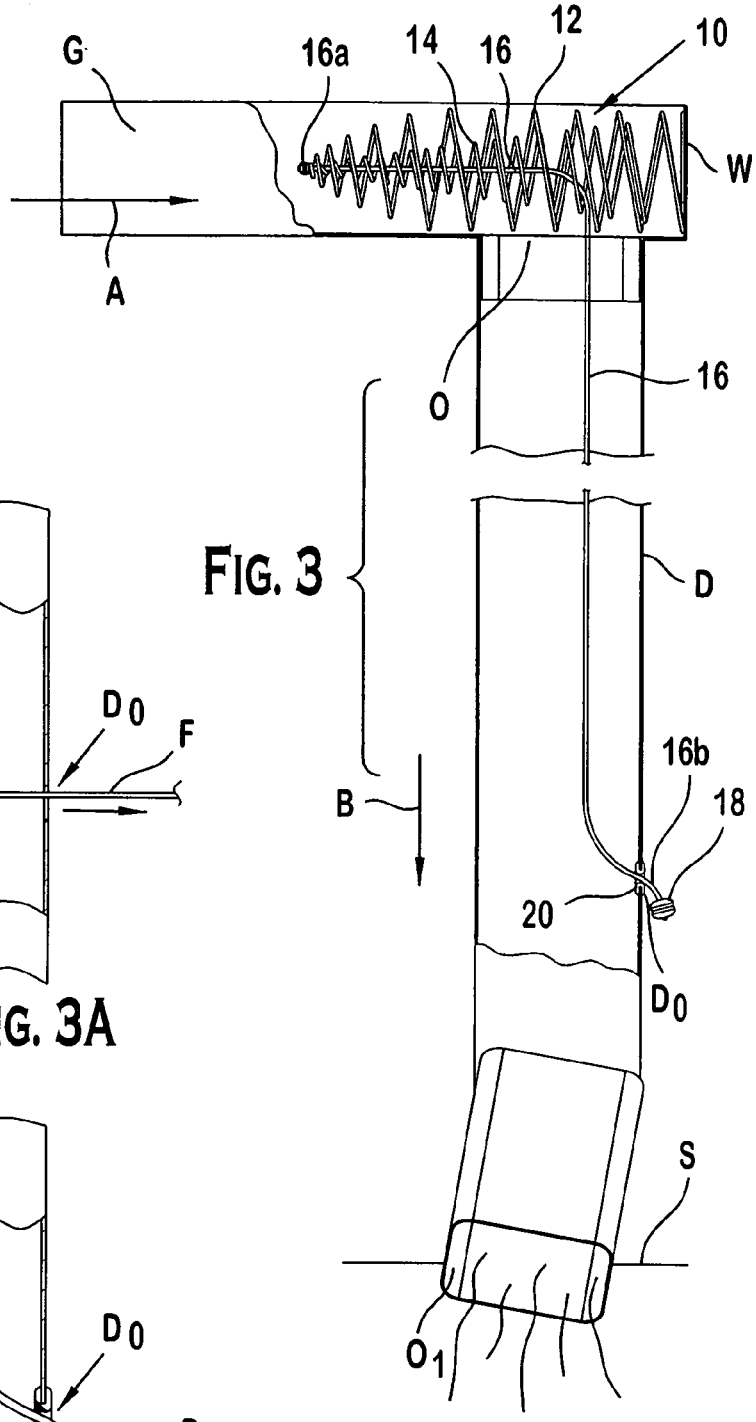
FIG. 3 is a simplified schematic view of the embodiment shown in FIG. 2.

As shown in FIG. 3, cord 16 extends outwardly through an opening $D_o$ in downspout D a suitable distance above the surface of the ground S. Liquid and small debris pass along gutter G in the direction shown by arrow A, through opening O and downspout D to be released at or near ground surface S through the bottom opening $O_1$ in downspout D.

In the event that debris becomes wedged in or around apparatus 10, cord 16 is pulled downwardly in the direction shown by arrow B, causing the ends 12*a*, 14*a* of spring-like members 12, 14 to be urged toward the right shown by arrow A. The large diameter ends 12*b*, 14*b* of spring-like members 12, 14 engage gutter end wall W whereupon the spring-like members are contracted causing debris between adjacent windings of spring-like members 12, 14 to be ground and/or crushed. Cord 16 may be released and then pulled downwardly in the direction shown by arrow B several times or as many times as may be necessary to crush/grind the debris entering in the region between adjacent windings.

An enlarged member 18 may be secured to end 16*b* of cord 16 to prevent the cord from being pulled back into downspout D.

Figure 3A:
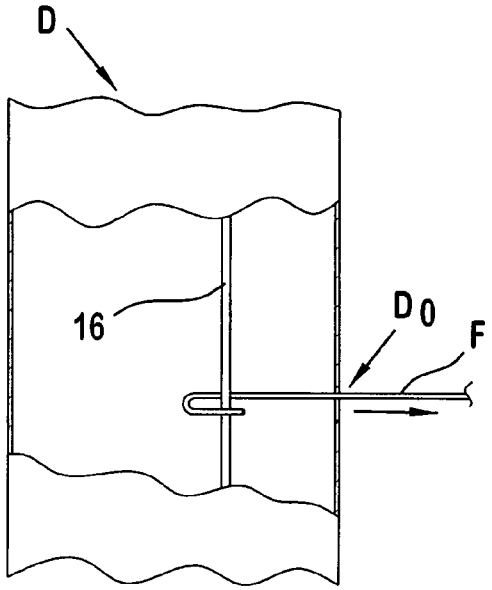
FIGS. 3A and 3B show detailed partial views of the downspout useful for explaining the installation and structure of the operating cord in the embodiment of FIG. 1.
Figure 3B:
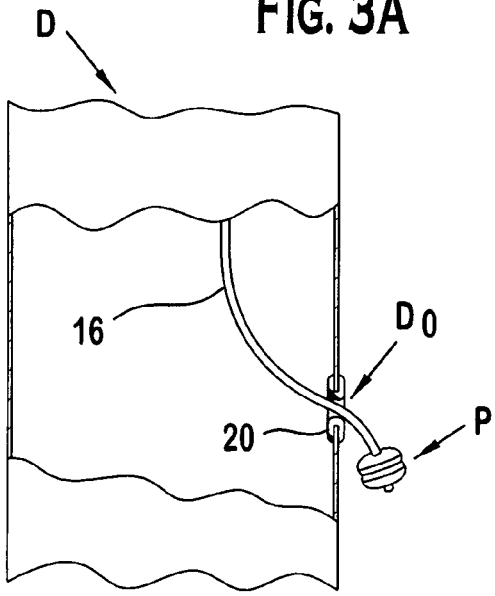

In order to install apparatus 10, the spring-like members 12, 14 are placed in a low end of the gutter so that the large diameter ends are adjacent to opening O in the gutter and communicating with the downspout and are further adjacent to the gutter end wall W. The cord is extended through opening O in gutter G. A small weight may be coupled to end 16*b*. An opening, preferably 0.50 inches in diameter, is formed in downspout D at a convenient height above the ground surface S. For example, the hole may be formed at about the shoulder height of an average person (see FIGS. 3A and 3B). The cord is pulled through the opening $D_o$ by a "fish" F. A grommet 20 is tightly fitted on the cord and is moved along the cord so that the grommet engages the marginal portion of opening $D_o$ to substantially seal opening $D_o$ when the spring-like members are in their normally expanded state and also provides a low friction sliding surface which is engaged by cord 16 when being moved upwardly and downwardly. Alternatively, the grommet may be a plug-like member P (see FIG. 3B) having an opening for receiving and frictionally engaging said cord. The plug-like member P is pushed into the opening to plug and thus seal the opening. In the event that the plug is pulled out of opening $D_o$ when the cord is pulled downwardly, the plug P need only be replaced in the opening $D_o$ when the grinding/crushing operation is completed. Cord 16 is formed of a suitable plastic material such as nylon which is typically utilized in marine applications and has a useful operating life of the order of ten to fifteen years. The spring-like members are preferably formed of spring steel and are capable of long, useful operating life and are further non-corrosive thereby providing apparatus for crushing and grinding debris which may collect in gutters and the like. Although the apparatus is shown employed in a single gutter, it should be understood that the apparatus 10 may be provided in each gutter of a house or other building having similar gutter/downspout arrangements.

The invention claimed is:

1. In combination, a gutter having an opening communicating with an upper end of a downspout and a device positioned in said gutter and above said opening for preventing leaves and other debris from passing through said opening, said device comprising:

a first tapered helical coil;

a second tapered helical coil surrounding said first helical coil;

narrow ends of said tapered coils being joined;

said coils being positioned in said gutter so that wide ends of said coils are positioned above said gutter opening and said joined narrow ends extending away from said gutter opening;

said first tapered helical coil being wound in a reverse direction from said second tapered helical coil;

a cord having one end coupled to said joined ends and extending generally along a central axis of said coils and downward through said gutter opening and said downspout;

an opposite end of said cord passing through an opening in said downspout below said gutter for contracting said helical coils when said cord is pulled downwardly; and said helical coils expanding when said cord is released, whereby contraction and expansion of said helical coils crushes and grinds debris extending into said helical coils to enable the debris to be carried by liquid passing through said device and entering into said downspout.

2. The combination of claim 1 further comprising a member coupled to the end of said cord extending through said opening in said downspout to prevent the end of cord from reentering said downspout.

3. The combination of claim 1 wherein said tapered helical coils have diameters at said wide ends which are at least equal to a diameter of the opening in said gutter communicating with said downspout.

4. The combination of claim 1 wherein said gutter has an end wall adjacent to said gutter opening; and the wide ends of said helical coils engaging said end wall whereby when said cord is pulled in a downward direction said helical coils contract due to movement of the joined narrow ends of the helical coils toward said gutter end wall.

5. A method for installing a combination strainer and grinder device enabling water and small size debris to pass through said device and being selectively contractable and expandable to grind and crush debris, comprising:

placing said device in a gutter and above an opening in said gutter communicating with an upper end of a downspout; the gutter comprising a horizontal bottom surface, a front wall, a rear wall, and two vertical end walls; coupling a cord to one end of said device;

extending said cord through a central region of said device and through a passageway in said device located above said gutter opening and downwardly through said downspout;

forming an opening in said downspout at a location a given distance below said gutter opening;

pulling said cord through said opening; and placing an opposite end of said device against a vertical end wall of said gutter adjacent to said gutter opening to limit movement of said device when said cord is drawn downwardly thereby causing said device to contract to crush and grind debris entering passageways in said device.

6. The method of claim 5 further comprising:

releasing said cord enabling said device to expand and thereby enable liquid and debris smaller than a given size to pass through said device and into said downspout.

* * * * *